US007762009B2

(12) United States Patent
Gerber

(10) Patent No.: US 7,762,009 B2
(45) Date of Patent: Jul. 27, 2010

(54) ARTICLE OF FOOTWEAR WITH CIRCULAR TREAD PATTERN

(75) Inventor: Clifford B. Gerber, West Linn, OR (US)

(73) Assignee: Nike, Inc., Beaverton, OR (US)

( * ) Notice: Subject to any disclaimer, the term of this patent is extended or adjusted under 35 U.S.C. 154(b) by 749 days.

(21) Appl. No.: 11/685,060

(22) Filed: Mar. 12, 2007

(65) Prior Publication Data

US 2008/0222921 A1 Sep. 18, 2008

(51) Int. Cl.
*A43B 23/28* (2006.01)

(52) U.S. Cl. ..... 36/59 C; 36/59 R; 36/128

(58) Field of Classification Search ..... 36/59 R, 36/59 C, 114, 32 R, 126, 128; D2/951–954
See application file for complete search history.

(56) References Cited

U.S. PATENT DOCUMENTS

| | | | | | |
|---|---|---|---|---|---|
| D39,747 | S | | 1/1909 | McKenna | |
| 1,876,195 | A | | 9/1932 | Youmans | |
| 1,988,784 | A | * | 1/1935 | Carrier | 36/59 C |
| D114,340 | S | | 4/1939 | MacLeod | |
| D123,602 | S | | 11/1940 | Reeves | |
| D125,656 | S | | 3/1941 | Cutler | |
| D201,864 | S | * | 8/1965 | Smith, III | D2/953 |
| D234,930 | S | | 4/1975 | Arambasic | |
| 4,266,349 | A | | 5/1981 | Schmohl | |
| 4,281,467 | A | | 8/1981 | Anderie | |
| 4,347,674 | A | | 9/1982 | George | |
| D275,146 | S | | 8/1984 | Kilgore | |
| 4,541,186 | A | | 9/1985 | Mulvihill | |
| 4,571,852 | A | | 2/1986 | Lamarche et al. | |
| 4,653,206 | A | | 3/1987 | Tanel | |
| 4,670,997 | A | * | 6/1987 | Beekman | 36/114 |
| 4,689,901 | A | | 9/1987 | Ihlenburg | |
| D292,443 | S | | 10/1987 | Ihlenburg | |
| D293,503 | S | | 1/1988 | Mitsui et al. | |
| 4,777,738 | A | * | 10/1988 | Giese et al. | 36/32 R |
| D298,883 | S | | 12/1988 | Tanel | |
| D299,584 | S | | 1/1989 | Franklin | |
| D303,871 | S | * | 10/1989 | Driscoll | D2/955 |
| D304,778 | S | | 11/1989 | Le et al. | |
| 5,201,126 | A | | 4/1993 | Tanel | |
| 5,313,718 | A | * | 5/1994 | McMahon et al. | 36/59 C |
| D396,549 | S | | 8/1998 | von Conta et al. | |
| D401,043 | S | | 11/1998 | Truelsen | |
| 5,832,636 | A | | 11/1998 | Lyden et al. | |
| 6,035,559 | A | | 3/2000 | Freed et al. | |

(Continued)

FOREIGN PATENT DOCUMENTS

| | | |
|---|---|---|
| DE | 3127793 | 1/1983 |

(Continued)

*Primary Examiner*—Ted Kavanaugh
(74) *Attorney, Agent, or Firm*—Plumsea Law Group, LLC

(57) ABSTRACT

An article of footwear is disclosed. The article of footwear includes an outsole with a circular tread pattern. The circular tread pattern provides sufficient traction in all directions but also allows the wearer to pivot about a pivot portion. The circular tread pattern is generally large, and in some cases, the first and smallest circular tread extends less than 360 degrees. The pivot portion can include a slot that aids in flexibility. The outsole can also include a different tread pattern for the heel portion, or the circular tread pattern may also extend into the heel portion.

20 Claims, 9 Drawing Sheets

U.S. PATENT DOCUMENTS

| | | | | |
|---|---|---|---|---|
| 6,101,746 | A | 8/2000 | Evans | |
| D458,739 | S * | 6/2002 | Merceron | D2/954 |
| 6,460,273 | B2 | 10/2002 | Witjes | |
| 6,948,264 | B1 | 9/2005 | Lyden | |
| D607,191 | S * | 1/2010 | McClaskie | D2/953 |

FOREIGN PATENT DOCUMENTS

| | | |
|---|---|---|
| DE | 3433070 | 3/1986 |
| JP | 4279102 | 10/1992 |

* cited by examiner

ARTICLE OF FOOTWEAR WITH CIRCULAR TREAD PATTERN

BACKGROUND OF THE INVENTION

1. Field of the Invention

The present invention relates generally to an article of footwear and more particularly to an article of footwear having a circular tread pattern.

2. Description of Related Art

Shoes and other articles of footwear having circular tread patterns have been proposed. U.S. Pat. No. 5,313,718 to McMahon et al., and assigned to Nike, Inc., is directed to an athletic shoe with bendable traction projections. These traction projections are generally circular columns that are designed to bend or deform when a stress is applied. The free ends of the traction projections are designed so they deform until the entire free end is disposed within their respective groove.

While the innovative design proposed by McMahon is suitable, modifications to improve performance could be made. For example, there may be a need for increased flexibility. There could be a need for additional traction while the athletic shoe is pivoted, and there could be a need to increase the pivoting capabilities.

SUMMARY OF THE INVENTION

The invention provides an article of footwear with a circular tread pattern. In one aspect, the invention provides an article of footwear comprising: an outsole including a circular tread pattern disposed on a forefoot portion; the circular tread pattern including a first circular tread having a first radius, the first radius being the smallest radius of any circular tread; the first circular tread extending less than 360 degrees in a circumferential direction around a center of the circular tread pattern; the first circular tread comprising a plurality of tread elements disposed in a first circular groove; the tread elements having a generally elongated shape with a radial width and a circumferential thickness, wherein the radial width is greater than the circumferential thickness; the circular tread pattern also including a second circular tread having a second radius greater than the first radius; and where the second circular tread also extends less than 360 degrees in a circumferential direction around a center of the circular tread pattern.

In another aspect, the circular tread pattern includes a third circular tread.

In another aspect, the third circular tread has a third radius, the third radius being larger than the second radius, and wherein the third circular tread is discontinuous.

In another aspect, a first portion of the third circular tread is disposed forward of a slot disposed in a pivot portion.

In another aspect, a second portion of the third circular tread is disposed rearward of the slot.

In another aspect, the invention provides an article of footwear comprising: an outsole including a circular tread pattern disposed on a forefoot portion; the circular tread pattern including a first circular tread having a first radius, the first radius being the smallest radius of any circular tread; the first circular tread extending less than 360 degrees in a circumferential direction around a center of the circular tread pattern; the first circular tread comprising a plurality of tread elements disposed in a first circular groove; and the outsole including a heel portion with a tread pattern different than the circular tread pattern disposed on the forefoot portion.

In another aspect, the first circular tread includes a plurality of tread elements disposed in a first circular groove; the tread elements having a generally elongated shape with a radial width and a circumferential thickness, wherein the radial width is greater than the circumferential thickness.

In another aspect, a slot extends through a pivot portion located within the first circular tread, wherein the slot improves flexibility in bending of the article of footwear.

In another aspect, the circular tread pattern also includes a second circular tread having a second radius greater than the first radius; and where the second circular tread also extends less than 360 degrees in a circumferential direction around a center of the circular tread pattern.

In another aspect, the circular tread pattern includes a third circular tread adjacent to the second circular tread having a third radius greater than the second radius, wherein the third circular tread is discontinuous and includes a first portion separated from a second portion.

In another aspect, the circular tread pattern includes a fourth circular tread adjacent to the third circular tread having a fourth radius greater than the third radius, wherein the fourth circular tread is discontinuous and includes a first portion separated from a second portion.

In another aspect, the circular tread pattern includes a fifth circular tread adjacent to the fourth circular tread having a fifth radius greater than the fourth radius, wherein the fifth circular tread extends less than 180 degrees in a circumferential direction.

In another aspect, a slot extends through a pivot portion located within the first circular tread, wherein the slot improves flexibility in bending of the article of footwear.

In another aspect, the invention provides an article of footwear comprising: an outsole including a circular tread pattern disposed on a forefoot portion of the outsole; the circular tread pattern including a first circular tread having a first radius, the first radius being the smallest radius of any circular tread; the first circular tread extending less than 360 degrees in a circumferential direction around a center of the circular tread pattern; the first circular tread comprising a plurality of tread elements disposed in a first circular groove; and a slot extending through a pivot portion located within the first circular tread, wherein the slot improves flexibility in bending of the article of footwear.

In another aspect, the outsole includes a second slot laterally spaced from the first slot and aligned with the first slot.

In another aspect, the outsole includes a third slot disposed rearward of the second slot.

In another aspect, the second slot is disposed between a first portion of a third circular tread and a second portion of a third circular tread, wherein the third circular tread is disposed radially outward of the first circular tread.

In another aspect, the outsole includes a fifth circular tread disposed radially outward of the first circular tread, a second circular tread, a third circular tread and a fourth.

In another aspect, the fourth circular tread extends less than 180 degrees in a circumferential direction.

In another aspect, the outsole consists essentially of five circular treads.

In another aspect, the invention provides an article of footwear comprising: an outsole including a circular tread pattern, the circular tread pattern formed of a plurality of circular treads extending over a forefoot portion of the outsole and a heel portion of the outsole, a pivot tread element positioned substantially at a center of the circular tread pattern, the pivot tread having a generally circular cross-sectional shape, the center of the circular tread pattern being common to all of the plurality of circular treads, the circular tread pattern including a first circular tread having a first radius, the first radius being the smallest radius of any circular tread, the first circular tread comprising a plurality of circular tread elements disposed around the pivot tread element, the circular tread elements having a generally elongated shape with a radial width and a circumferential thickness, wherein the radial width is greater than the circumferential thickness, and the circular tread pattern also including a second circular tread having a second radius greater than the first radius.

In another aspect, the second circular tread is confined to the forefoot portion and extends less than 360 degrees in a circumferential direction around the center of the circular tread pattern.

In another aspect, the circular tread pattern includes at least one additional circular tread disposed in the forefoot portion having a radius greater than a second circular tread radius, wherein the at least one additional circular tread extends less than 360 degrees in a circumferential direction around the center of the circular tread pattern.

In another aspect, the circular tread pattern includes at least one circular tread disposed in the heel portion, wherein the at least one circular tread extends less than 360 degrees in a circumferential direction.

In another aspect, the tread elements have a generally elongated shape with a major axis oriented radially and a minor axis oriented circumferentially.

In another aspect, the tread elements are directly connected to and extend away from the outsole.

In another aspect, at least some of the tread elements are sized differently than the remainder of the tread elements.

In another aspect, a slot extending through the outsole substantially in the vicinity of a toe joint portion of the article of footwear, wherein the slot improves flexibility in bending of the article of footwear.

In another aspect, the invention provides an article of footwear comprising: an outsole including a circular tread pattern, the circular tread pattern formed of a plurality of circular treads extending over the entire outsole, a circular pivot tread element positioned substantially at a center of the circular tread pattern, the pivot tread having a generally circular cross-sectional shape, and the center of the circular tread pattern being common to all of the plurality of circular treads.

In another aspect, the circular tread pattern includes at least one additional circular tread disposed in a forefoot portion of the outsole, wherein the at least one additional circular tread extends less than 360 degrees in a circumferential direction around the center of the circular tread pattern.

In another aspect, the circular tread pattern includes a first circular tread disposed in the forefoot portion, wherein the first circular tread extends 360 degrees in a circumferential direction around the center of the circular tread pattern.

In another aspect, the circular tread pattern includes at least one additional circular tread disposed in the heel portion, wherein the at least one additional circular tread extends less than 360 degrees in a circumferential direction around the center of the circular tread pattern.

In another aspect, a plurality of tread elements forming the plurality of circular treads, each tread element having an elongated shape with a major axis oriented radially and a minor axis oriented circumferentially, wherein the plurality of tread elements are connected to and extend outward from a bottom surface of the outsole.

In another aspect, the invention provides an article of footwear comprising: an outsole including a circular tread pattern, the circular tread pattern formed of a plurality of circular treads extending over a forefoot portion of the outsole and a heel portion of the outsole, a plurality of tread elements forming the plurality of circular treads, each tread element having an elongated shape with a major axis oriented radially and a minor axis oriented circumferentially, the plurality of tread elements connected to and extending outward from a bottom surface of the outsole.

In another aspect, the circular tread pattern includes at least one additional circular tread disposed in the forefoot portion, wherein the at least one additional circular tread extends less than 360 degrees in a circumferential direction around the center of the circular tread pattern.

In another aspect, a circular pivot tread positioned at or near a center of the circular tread pattern.

In another aspect, the circular tread pattern includes a plurality of circular treads.

In another aspect, the center of the circular tread pattern is common to all of the plurality of circular treads.

In another aspect, a plurality of tread elements forming the circular tread patter, wherein each tread element having an elongated shape with a major axis oriented radially and a minor axis oriented circumferentially;

In another aspect, the plurality of tread elements are connected to and extend outward from a bottom surface of the outsole.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
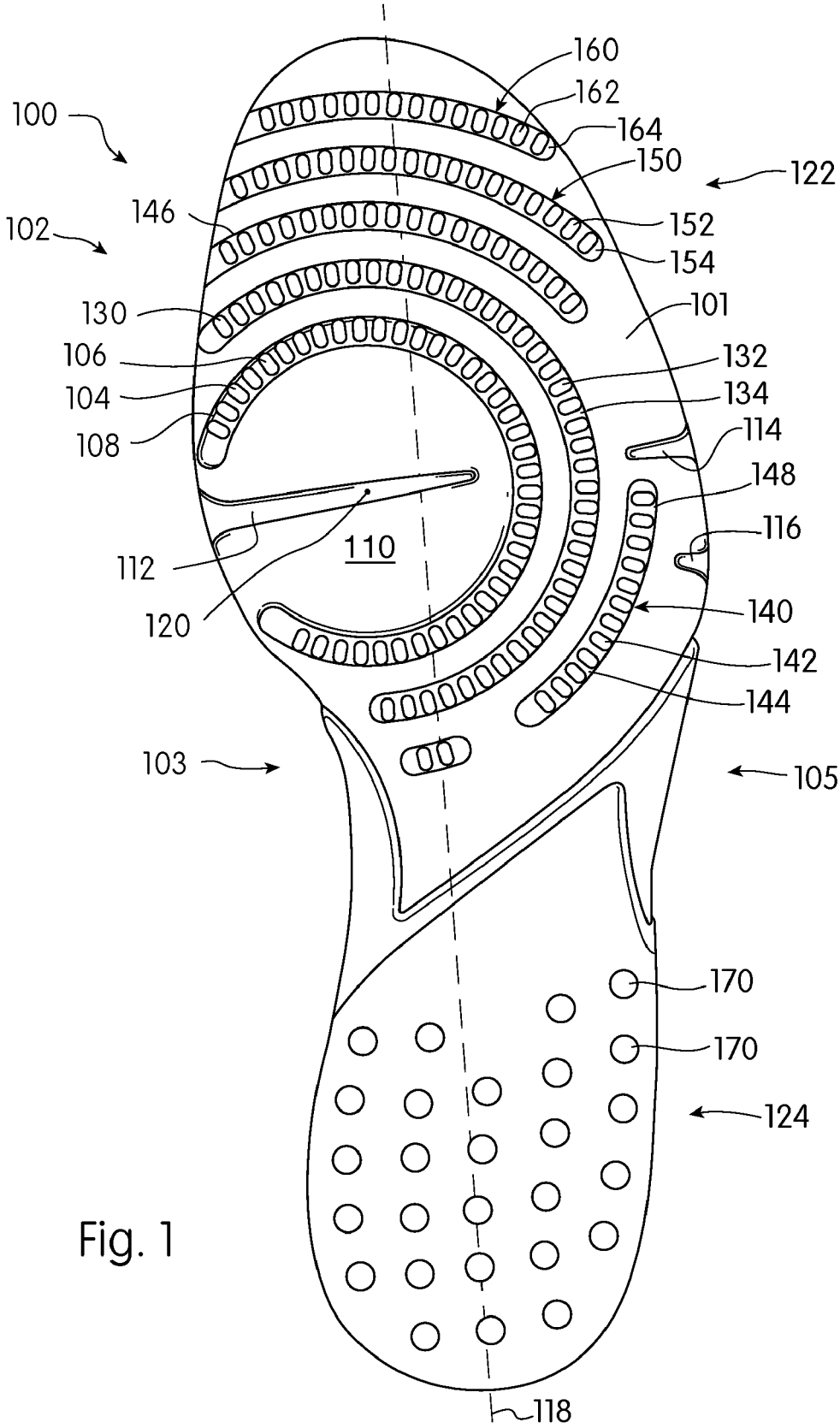
FIG. 1 is a schematic diagram of a preferred embodiment of an outsole.

FIG. 1 is a schematic diagram of a preferred embodiment of an outsole 100 of an article of footwear. Preferably, outsole 100 includes a circular tread pattern 102. In some embodiments, circular tread pattern 102 is disposed on at least a portion of outsole 100. In the embodiment shown in FIG. 1, circular tread pattern 102 is disposed on forefoot portion 122. Circular tread pattern 102 provides sufficient traction in all directions but also allows the wearer to pivot.

Circular tread pattern 102 can include one or several circular treads. In the embodiment shown in FIG. 1, circular tread pattern 102 includes first circular tread 104. First circular tread 104 includes a plurality of tread elements 106 that are disposed in first circular groove 108. Circular groove 108 is formed in the bottom 101 of outsole 100. Preferably, bottom 101 of outsole 100 extends from the medial side 103 to the lateral side 105. Preferably, bottom 101 of outsole 100 extends to cover the entire bottom of forefoot portion 122.

Bottom 101 of outsole 100 is preferably made of a relatively low friction material. Some examples of possible low friction materials that can be used to form outsole 100 include thermoplastic materials. In contrast to the materials used to make outsole 100, tread elements 106 are preferably made of relatively high friction material. In a preferred embodiment, tread elements 106 are preferably made of a material having a coefficient of sliding friction that is greater than the coefficient of sliding friction for outsole 100.

Preferably, outsole 100 includes provisions that allow for improved pivoting capability. In one embodiment, an enlarged pivot portion 110 is disposed within first circular tread 104. This enlarged pivot portion 110 is preferably disposed near the ball of a wearer's foot. Pivot portion 110 is preferably formed of bottom 101 of outsole 100 and provides a large, low friction area where the ball of the user's foot can conveniently rotate the article of footwear.

Some embodiments include provisions to enhance the flexibility of outsole 100. In the embodiment shown in FIG. 1, a slot 112 is provided in outsole 100. In a preferred embodiment, slot 112 extends through a pivot portion 110. Slot 112 provides an area that is generally weaker in bending the band of other portions of outsole 100. Slot 112 helps to improve bending flexibility. In some embodiments, a second slot 114 is also provided to improve bending performance. In a preferred embodiment, second slot 114 is laterally spaced from slot 112; and in an exemplary embodiment, second slot 114 is aligned with slot 112. Some embodiments include a third slot 116. Third slot 116 is preferably shorter than second slot 114 and is disposed rearward of second slot 114. Second slot 114 is preferably shorter than slot 112. In embodiments that include all three slots 112, 114 and 116, those slots can operate in unison to provide an overall improved bending flexibility of outsole 100.

Preferably, first circular tread 104 is disposed on outsole 100 to permit a user to easily pivot about the ball of the wearer's foot. To improve the pivoting performance of outsole 100, circular tread pattern 102 is preferably offset from longitudinal axis 118 of outsole 100. Longitudinal axis 118 is a hypothetical axis that connects the extreme forward point of outsole 100 with the extreme rearward point of outsole 100, as shown in FIG. 1. It can be observed in FIG. 1 that the center 120 of circular tread pattern 102 is offset from longitudinal axis 118 of outsole 100. Preferably, center 120 of circular tread pattern 102 coincides with the general position of a ball of the wearer's foot.

Another feature that can assist in improving the pivoting performance of outsole 100 is the reduction of tread elements 106. The relatively large size of pivot portion 110 provides a first circular tread 104 that generally does not extend around 360 degrees. In a preferred embodiment, first circular tread 104 extends less than 360 degrees circumferentially around center 120.

Some embodiments include a second circular tread 130. In the embodiment shown in FIG. 1, second circular tread 130 comprises a second set of tread elements 132 disposed in second groove 134. Preferably, second circular tread 130 is disposed radially outward of first circular tread 104 and has a generally circular shape. In the preferred embodiment, second circular tread 130 is coaxial and concentric with first circular tread 104, with both circular treads having a common center 120. Because second circular tread 130 is disposed radially outward of first circular tread 104, second circular tread 130 has a larger radius than first circular tread 104. Preferably, due to the location of second circular tread 130, second circular tread 130 does not extend 360 degrees circumferentially around center 120, but rather extends less than 360 degrees circumferentially around center 120. In a preferred embodiment, second circular tread 130 is adjacent to first circular tread 104. This means there are no other circular treads disposed between first circular tread 104 and second circular tread 130.

In some embodiments, a third circular tread is provided. In the embodiment shown in FIG. 1, third circular tread 140 includes a third set of tread elements 142 disposed in third circular groove 144. Preferably, third circular tread 140 has a generally circular shape and is coaxial and concentric with first circular tread 104 and second circular tread 130. Because of this arrangement, third circular tread 140 shares a common center 120 with first circular tread 104 and second circular tread 130. In some embodiments, third circular tread is discontinuous. This discontinuity can be observed in FIG. 1 where a portion of third circular tread is separated from another portion of third circular tread. As shown in FIG. 1, a first portion 146 of third circular tread 140 is disposed forward of a second portion 148 of third circular tread 140. In some cases these two portions 146 and 148 are separated by a slot. In the embodiment shown in FIG. 1, first portion 146 of third circular tread 140 and second portion 148 of third circular tread 140 are separated by second slot 114. Preferably third circular tread 140 is disposed radially outward from second circular tread 130 and is the radially adjacent tread to second circular tread 130. This means that there are no intervening circular treads between third circular tread 140 and second circular tread 130.

In some embodiments, a fourth circular tread is provided. In the embodiment shown in FIG. 1, fourth circular tread 150 includes a fourth set of tread elements 152 disposed in fourth groove 154. Preferably, fourth circular tread 150 is concentric and coaxial with first, second and third circular treads, and fourth circular tread 150 shares a common center 120 with all of those circular treads. In some embodiments, fourth circular tread 150 extends only along an upper portion of forefoot portion 122 of outsole 100. In the embodiment shown in FIG. 1, fourth circular tread 150 extends only along an upper portion of forefoot portion 122 and extends less than 180 degrees circumferentially about center 120. Preferably, fourth circular tread 150 is disposed radially outward of third circular tread 140, and fourth circular tread 150 is radially adjacent to third circular tread 140. This means that in a preferred embodiment, there are no intervening circular treads between fourth circular tread 150 and third circular tread 140.

Some embodiments include a fifth circular tread. In the embodiment shown in FIG. 1, fifth circular tread 160 includes a fifth set of tread elements 162 disposed in fifth groove 164. Preferably, a fifth circular tread 160 is concentric and coaxial with first, second, third and fourth circular treads, and fifth circular tread 160 shares a common center 120 with all of those circular treads. In some embodiments, fifth circular tread 160 extends only along an upper portion of forefoot portion 122 of outsole 100. In the embodiment shown in FIG. 1, fifth circular tread 160 extends only along an upper portion of forefoot portion 122 and extends less than 180 degrees circumferentially about center 120. Preferably, fifth circular tread 1650 is disposed radially outward of fourth circular tread 150, and fifth circular tread 160 is radially adjacent to fourth circular tread 150. This means that in a preferred embodiment, there are no intervening circular treads between fifth circular tread 160 and fourth circular tread 150.

In the exemplary embodiment shown in FIG. 1, circular tread pattern 102 includes five concentric and coaxial circular treads that are disposed radially outward of each other and all centered about center 120. In the exemplary embodiment shown in FIG. 1, only five circular treads are used. However, additional circular treads could be provided in other embodiments. Preferably, heel portion 124 of outsole 100 includes a different kind of tread pattern than circular tread 102. In the embodiment shown in FIG. 1, heel portion 124 does not include a circular tread pattern but rather a conventional tread pattern with linearly disposed heel tread elements 170.

In operation, the tread elements and their arrangement within the various circular treads provide 100 outsole with good traction, while at the same time, allowing outsole 100 to pivot. In a preferred embodiment, outsole 100 is configured to pivot about pivot portion 110. To facilitate this pivoting motion, the tread elements are preferably disposed in circular treads 104, 130, 140, 150 and 160. These circular treads allow the respective tread elements associated with those treads to deflect or move within their associated groove, while at the same time, limiting the motion of the tread elements in other directions. Additional details of the motion of the tread elements can be observed by considering the following example in FIGS. 2-6.

Figure 2:
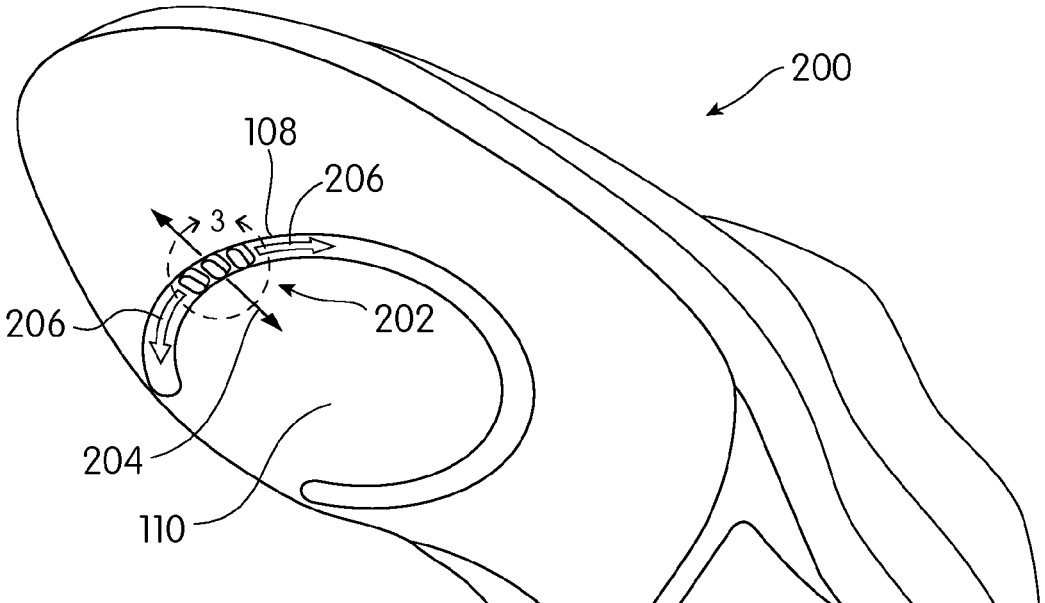
FIG. 2 is a bottom isometric view of a preferred embodiment of an article of footwear.
Figure 3:
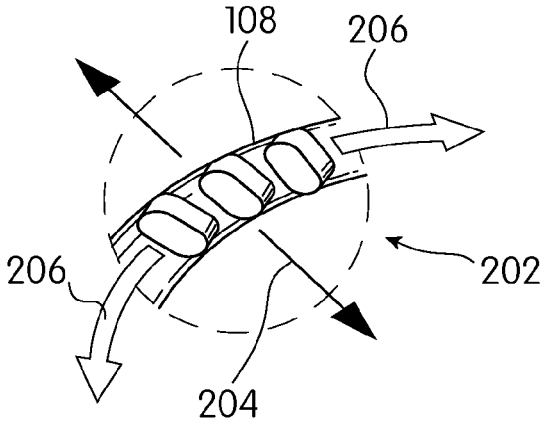
FIG. 3 is an enlarged isometric view of a preferred embodiment of a tread element.

FIG. 2 is a bottom isometric view of article of footwear 200 in a rest or original position. Preferably, article of footwear 200 includes outsole 100. Selected tread elements 202 associated with first circular tread 102 can be observed in FIG. 2. In other words, selected tread elements 202 have been selected from the first set of tread elements 106. For clarity, only selected tread elements 202 are shown in FIGS. 2 and 3. It should be kept in mind that in a preferred embodiment, outsole 100 would include all of the tread elements associated with all of the various circular treads shown in FIG. 1. It should also be kept in mind that the following description of the principles and operation of selected tread elements 202 are applicable to other all other tread elements.

As shown in FIGS. 2 and 3, which is an enlarged view of selected tread elements 202, those selected tread elements 202 extend generally away from outsole 100 and are vertically disposed when at rest. Selected tread elements 202 also assume this rest position when the wearer is walking, running, hoping standing, or performing any other activity other than pivoting. In other words, selected tread elements 202 act like conventional treads under most conditions.

Selected tread elements 202 remain generally vertically disposed, and their motion is restrained by their shape and their respective groove. Considering selected tread elements 202, first groove 108 helps to prevent selected tread elements 202 from moving in radial direction 204. Also, their oblong or racetrack shape further helps to prevent their motion or deflection in radial direction 204. In other words, selected tread elements 202 are less likely to lean or tilt along their longer dimension or side, which is radial direction 204.

Their shape and position, however, contribute to the outsole's 100 ability to permit pivoting. While selected tread elements 202 are restrained in radial direction 204 by first groove 108, they are not restrained in the circumferential direction 206. Also, the shape of selected tread elements 202 allows them to deflect or bend in the circumferential direction 206. This is because this circumferential bending would occur along their shorter dimension or side.

Figure 4:
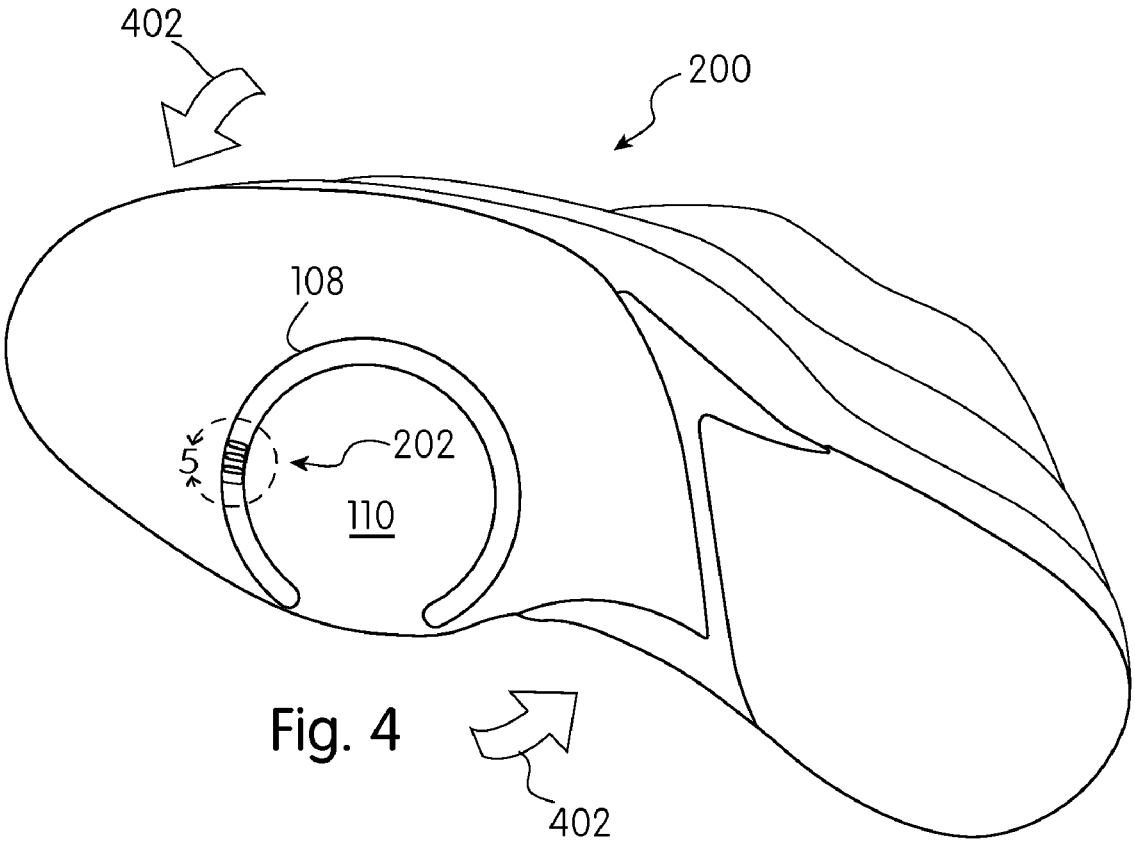
FIG. 4 is a bottom isometric view of a preferred embodiment of an article of footwear in a pivoted position.
Figure 5:
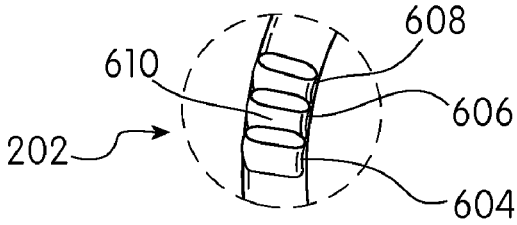
FIG. 5 is an enlarged isometric view of a preferred embodiment of a tread element.

FIGS. 4 and 5 are isometric views of article of footwear 200 after pivoting in the counter clockwise direction 402. The deflection of selected tread elements 202 can be observed in FIGS. 4 and 5. As shown in FIGS. 4 and 5, selected tread elements 202 deflect or lean after outsole 100 has been pivoted about pivot portion 110.

Figure 6:
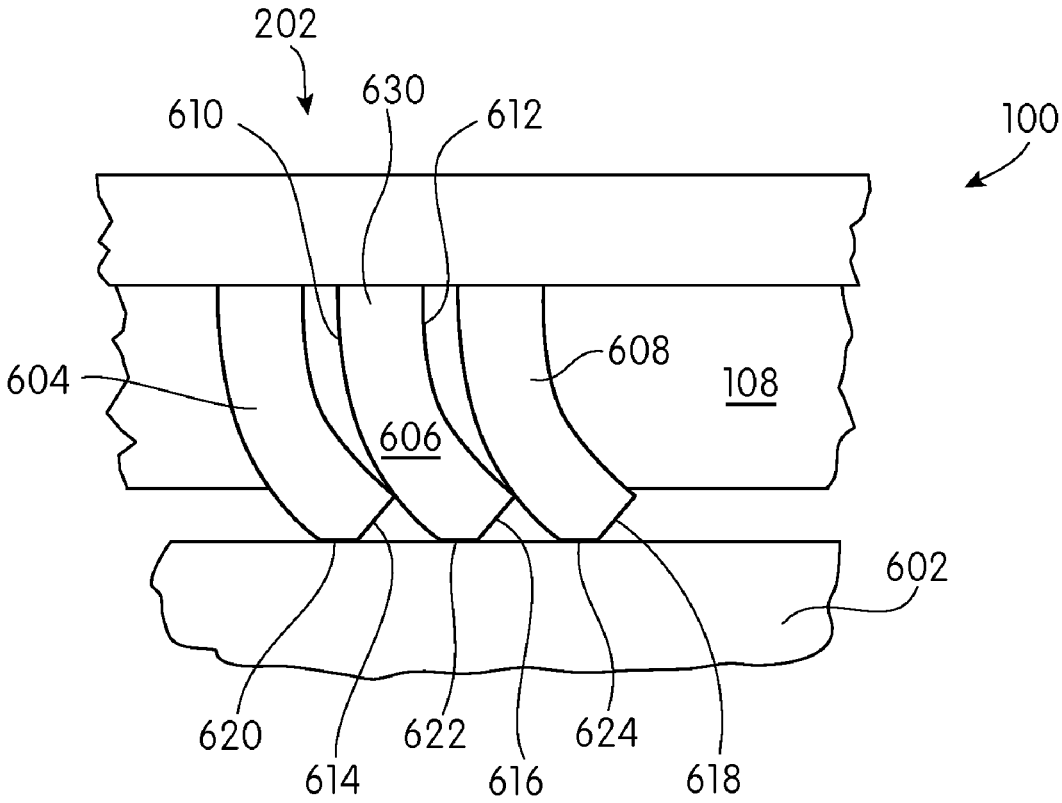
FIG. 6 is a cross-sectional view of a preferred embodiment of a tread element.

This deflected condition of selected tread elements 202 can also be observed in FIG. 6, which is a cross-sectional view of selected tread elements 202 taken along 6-6 in FIG. 5. As shown in FIG. 6, central tread element 606 includes first sidewall 610 and second sidewall 612. Preferably, first and second sidewalls 610 and 612 are circumferentially spaced and are the longer sidewalls of central tread element 606. When central tread element 606 is in the deflected condition, as shown in FIG. 6, first sidewall 610 can come into contact with first tread element 604 and second sidewall 612 can come into contact with second sidewall 608. This contact can help to provide mutual support to the tread elements and prevent them from buckling or collapsing under load. This contact and mutual support during deflection can also help to prevent over extension or excessive bending of one or many of the tread elements. This contact may occur in some embodiments, while in other embodiments, the tread elements are spaced such that no sidewall contact occurs.

When outsole 100 is pivoted, the tread elements can bend or deflect as if they were cantilever mounted to outsole 100. In the embodiment shown in FIG. 6, an upper portion 630 of central tread element 606 is mounted to outsole 100. Central tread element 606 extends from upper portion 630. When outsole 100 is pivoted, outsole 100 moves towards to left as shown in FIG. 6. The bottom portion 616, which was originally in contact with the ground 602, becomes tilted when outsole 100 is pivoted. After being pivoted, a contact portion 622 remains in contact with the ground 602, while a portion of bottom portion 616 may loose contact with the ground 602. The contact portion 622 can be comprised of some portions of bottom portion 616 and some portions of first sidewall 610. In other embodiments, contact portion 622 is comprised entirely of either first sidewall 610 or bottom portion 616.

Figure 7:
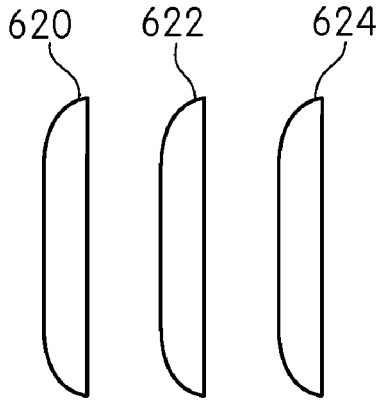
FIG. 7 is a schematic diagram of a preferred embodiment of various contact portions.

First tread element 604 can bend in a similar manner, providing a first contact portion 620. Second tread element 608 can also bend like first and central tread elements 604 and 606, providing second contact portion 624. The contact portions 620, 622 and 624 can be seen in FIG. 7. The elongated shape of the contact portions 620, 622 and 624 help to increase the contact area between the tread elements and the ground while outsole 100 is pivoted, thus providing increased traction and stability while pivoted. In this way, outsole 100 with its circular tread pattern 102 can provide improved traction both while at rest and while pivoted.

Figure 8:
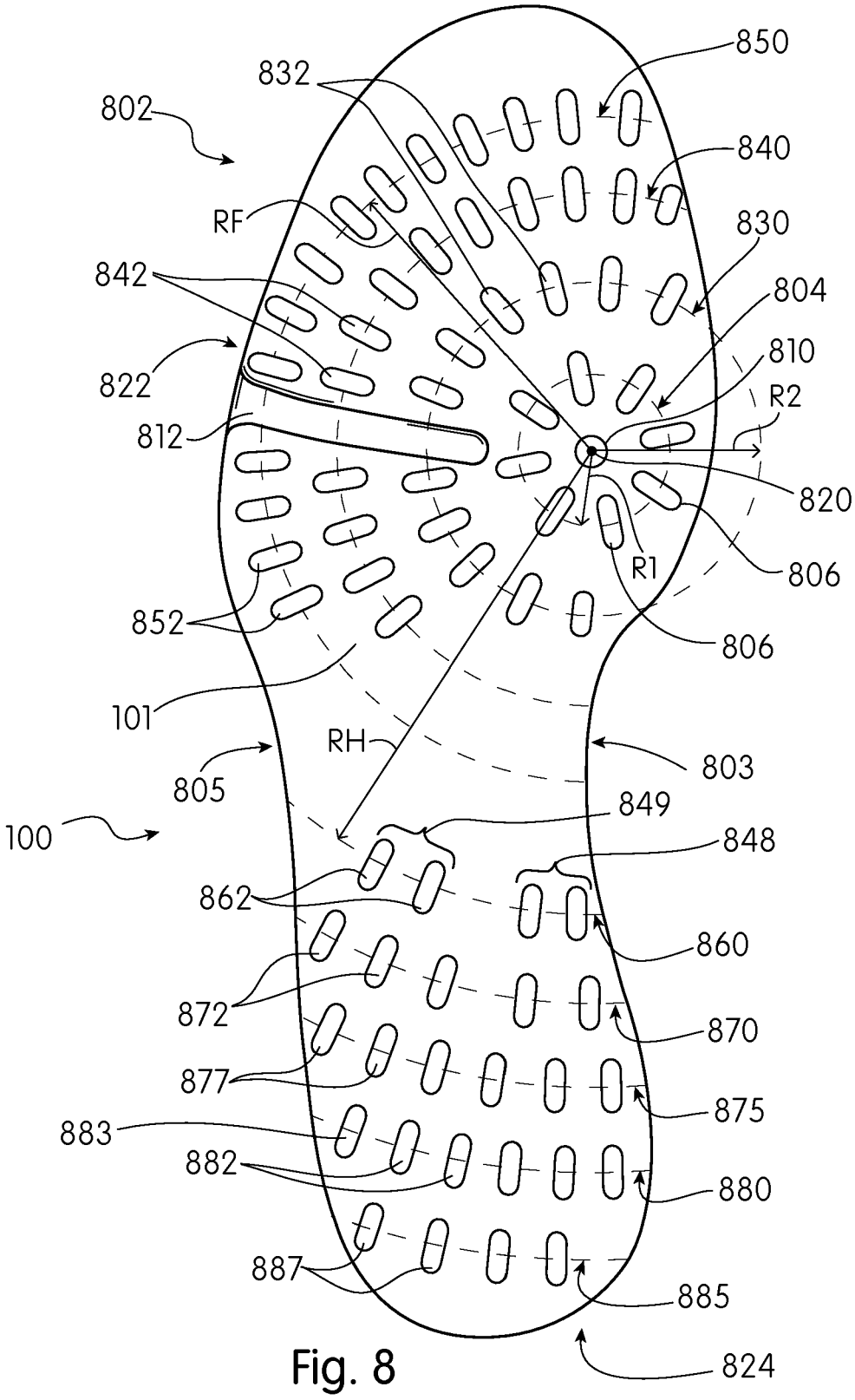
FIG. 8 is a schematic diagram of an alternate embodiment of an outsole.

FIG. 8 is a schematic diagram of an alternate embodiment of a circular tread pattern 802 for outsole 100. In this embodiment, circular tread pattern 802 is disposed on both a forefoot portion 822 and a heel portion 824 of outsole 100. In this embodiment, an optional slot 812 is provided to increase the flexibility of outsole 100. Slot 812 is similar to slot 112 discussed above, and is preferably a cutout positioned generally underneath the toe joint of the foot. Slot 812 can help to increase flexibility and help the article of footwear to bend.

Like circular tread pattern 102 described above, circular tread pattern 802 provides sufficient traction in all directions while allowing the wearer to pivot. In this embodiment, outsole 100 is configured to pivot about pivot tread 810. To facilitate this pivoting motion, the tread elements are preferably disposed into circular treads 804, 830, 840, 850, 860, 870, 875, 880, and 885, which are indicated by dashed lines in FIG. 8. Although nine circular treads are provided in the embodiment shown in FIG. 8, the actual number of circular treads may vary, with the actual number depending upon such factors, for example, the size of outsole 100 and the size of the tread elements.

Unlike circular tread pattern 102, discussed above, the tread elements in this embodiment are preferably not set into grooves. In this embodiment, tread elements, such as tread elements 806 in first circular tread 804, protrude directly from a bottom surface 101 of outsole 100. Similar to the tread elements in the first embodiment, discussed above, the tread elements in this embodiment are preferably made of a deformable material having a coefficient of sliding friction that is greater than the coefficient of sliding friction for outsole 100. For example, if outsole 100 is coated with a relatively low-friction material such as Teflon®, then tread elements 806 may be made from rubber. Also, similar to the tread elements in the first embodiment, tread elements 806 preferably have a generally elongated shape with a minor axis 826 of the shape oriented radially and the major axis 825 of the elongated shape oriented circumferentially.

As with circular tread pattern 102, discussed above, circular tread pattern 802 preferably includes provisions that allow for improved pivoting capability. In this embodiment, pivot tread 810 is provided at or near the ball of a wearer's foot. Pivot tread 810 is of a similar height to the other tread elements in circular tread pattern 802, although pivot tread 810 is preferably generally circular in shape as opposed to the elongated shape of the other tread elements. Further, pivot tread 810 is preferably made of a material having a coefficient of sliding friction the same or nearly the same as that of outsole 100 to facilitate pivoting on pivot tread 810. Because of this arrangement, pivot tread 810 provides a low friction area on which the ball of the wearer's foot can conveniently rotate the article of footwear.

Preferably, the circular treads of circular tread pattern 802 are arranged into concentric or nearly concentric circles. In other words, all of the circular treads, both those in forefoot portion 822 and those in heel portion 824, share a common center point 820. Pivot tread 810 is preferably positioned at or near the center point 820 of circular tread pattern 802. In another embodiment, in which the circular tread pattern extends to heel portion 824, multiple circle centers may be used, for example with a center point for forefoot region 822 and a different circle center point for heel region 824.

First circular tread 804 is formed of tread elements 806. As measured from center point 820, first circular tread 804 has the smallest radius, R1, of any circular tread in circular tread pattern 802. Preferably, the size of radius R1 permits that tread elements 806 may be arranged in a full, 360° circle around pivot tread 810. In other words, the circle defined by first circular tread 804 is sufficiently small to be able to encircle common center 820 entirely on outsole 100. While tread elements 806 are substantially evenly spaced along first circular tread 804, in other embodiments, any of the tread elements of circular tread pattern 802 may be spaced unevenly along the circular treads, such that the spaces between adjacent tread elements are not the same or nearly the same along the length of the circular tread.

In this embodiment, a second circular tread 830 is formed from the arrangement of tread elements 832 on outsole 100 at a radius R2 as measured from center point 820. Radius R2 is greater than radius R1, so that second circular tread 830 is spaced radially outward from and partially surrounds first circular tread 804. As shown in FIG. 8, radius R2 is sufficiently large such that the circle defined by second circular tread 830 extends beyond the medial side edge 803 of outsole 100. As such, tread elements 832 cannot be arranged into a full 360° around center 820 on outsole 100. Instead, tread elements 832 are arranged into an arc, with the dashed line in FIG. 8 indicating how the circle defined by second circular tread 830 extends off of outsole 100.

In this embodiment, a third circular tread 840 is formed from the arrangement of tread elements 842 on outsole 100 and spaced radially outward from and partially surrounding second circular tread 830. Like second circular tread 830, the circle defined by third circular tread is sufficiently large so as to extend beyond the medial side edge 803 of outsole 100. As such, tread elements 842 cannot be arranged into a full 360° around center 820 on outsole 100, but are instead arranged into an arc of the circle defined by third circular tread 840. Preferably, the arc length of tread elements 842 is smaller than the arc length of circular treads 832. Additionally, tread elements 842 are confined to forefoot portion 822. Tread elements 842 may, but preferably do not, sit on a ray extending from center 820 in order to inhibit unintentional collapse of tread elements 842.

A fourth circular tread 850 is formed from the arrangement of tread elements 852 on outsole 100 and spaced radially outward from and partially surrounding second circular tread 830 at a radius RF. Radius RF is preferably the largest radius of the circular treads in forefoot portion 822 of outsole 100. Like second circular tread 830 and third circular tread 840, the circle defined by fourth circular tread 850 is sufficiently large so as to extend beyond the medial side edge 803 of outsole 100. As such, tread elements 852 are arranged into an arc of the circle defined by fourth circular tread 850. Preferably, the arc into which tread elements 852 are arranged is smaller than the arc into which circular treads 842 are arranged. Further, tread elements 852 are preferably confined to forefoot region 822.

In heel portion 824, a fifth circular tread 860 is formed from the arrangement of tread elements 862 on outsole 100 spaced radially outward from fourth circular tread 850 at a radius RH as measured from center 820. Radius RH is preferably the smallest radius of the circular treads in heel portion 824 of outsole 100. Further, Radius RH is preferably larger than radius RF. As such, all of the circles defined by the circular tread patterns in heel portion 824, namely circular tread patterns 860, 870, 875, 880, and 885, are larger than the circles defined by the circular tread patterns in forefoot portion 822, namely circular tread patterns 804, 830, 840, and 850.

Like the forefoot portion circular treads, the circle defined by fifth circular tread 860 is sufficiently large so as to extend beyond the medial side edge 803 of outsole 100. In addition, the circle defined by fifth circular tread 860 also extends beyond the lateral side edge 805 of outsole 100. As such, tread elements 862 are arranged into an arc of the circle defined by fifth circular tread 860. Preferably, the arc length of tread elements 862 is smaller than the arc lengths of the circular treads in forefoot region 822. Additionally, all of tread elements 862 are confined to heel portion 824.

Further, the arc into which tread elements 862 are arranged are further broken into two distinct groups, first group 848 and second group 849. As these groupings of tread elements 862 show, the tread elements in the present embodiment may be formed into various patterns along the arcs or circles of the treads. For example, the tread elements may form continuous patterns, such as tread elements 806. Alternatively, the tread elements may be arranged into discontinuous patterns to avoid other features of outsole 100, such as how the arc of tread elements 840 is broken by slit 812. Further, as with tread elements 862, the tread elements may be arranged into discontinuous patterns for other reasons, such as aesthetics.

A sixth circular tread 870 is formed from the arrangement of tread elements 872 on outsole 100 and spaced radially outward from fifth circular tread 860. As with fifth circular tread 860, the circle defined by sixth circular tread 870 is sufficiently large so as to extend beyond the medial side edge 803 of outsole 100 and the lateral side edge 805 of outsole 100. As such, tread elements 872 are arranged into an arc of the circle defined by sixth circular tread 870.

A seventh circular tread 875 is formed from the arrangement of tread elements 877 on outsole 100 and spaced radially outward from sixth circular tread 870. As with sixth circular tread 870, the circle defined by seventh circular tread 875 is sufficiently large so as to extend beyond the medial side edge 803 of outsole 100 and the lateral side edge 805 of outsole 100. As such, tread elements 877 are arranged into an arc of the circle defined by seventh circular tread 875.

An eighth circular tread 880 is formed from the arrangement of tread elements 882 on outsole 100 and spaced radially outward from seventh circular tread 870. As with seventh circular tread 870, the circle defined by eighth circular tread 880 is sufficiently large so as to extend beyond the medial side edge 803 of outsole 100 and the lateral side edge 805 of outsole 100. As such, tread elements 882 cannot be arranged into a full 360° around center 820 on outsole 100, but are instead arranged into an arc of the circle defined by eighth circular tread 880.

Additionally, as shown by extreme lateral-side tread element 883, the tread elements in this embodiment need not have uniform sizes. In eighth circular tread 880, tread element 883 is smaller than the other tread elements 882 so that tread element 883 may be fitted into the relatively small area of outsole 100 available near the lateral side edge 805. These small or large treads may be positioned anywhere within circular tread pattern 802.

A ninth circular tread 885 is formed from the arrangement of tread elements 887 on outsole 100 spaced radially outward from eighth circular tread 880. As with eighth circular tread 880, the circle defined by ninth circular tread 885 is sufficiently large so as to extend beyond the medial side edge 803 of outsole 100 and the lateral side edge 805 of outsole 100. As such, tread elements 887 are arranged into an arc of the circle defined by ninth circular tread 885.

The tread elements of the embodiment shown in FIG. 8 operate similarly to the tread elements in the embodiment shown in FIG. 1, described above. As shown in FIGS. 9-16, the tread elements of the present embodiment provide outsole 100 with good traction while bending or deflecting radially when article of footwear 200 is pivoted about pivot tread 810.

Figure 9:
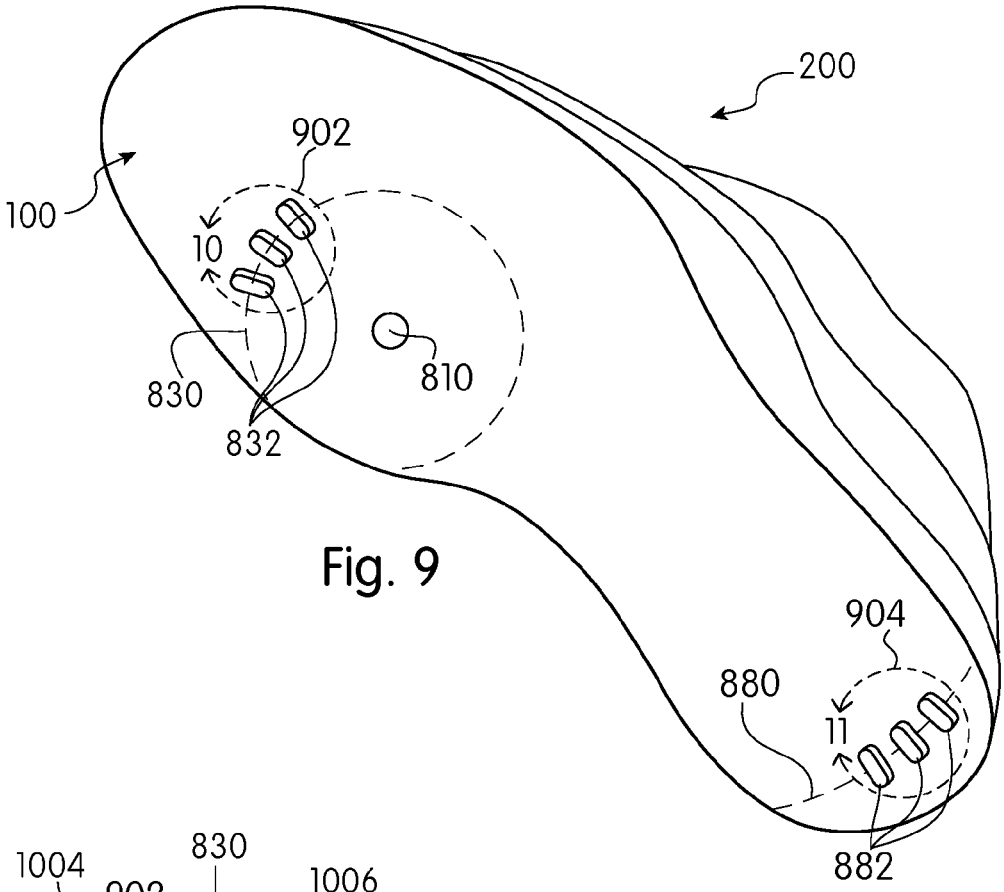
FIG. 9 is a bottom isometric view of an alternate embodiment of an article of footwear.
Figure 10:
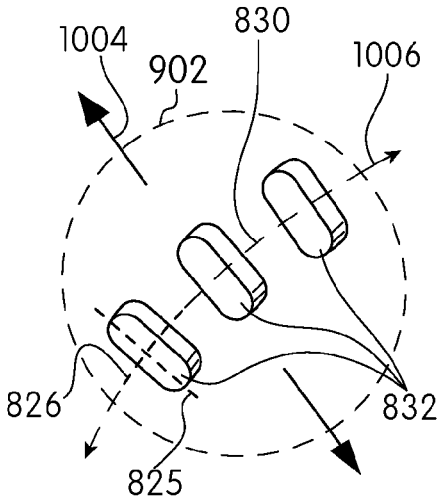
FIG. 10 is an enlarged isometric view of a preferred embodiment of a tread element.
Figure 11:
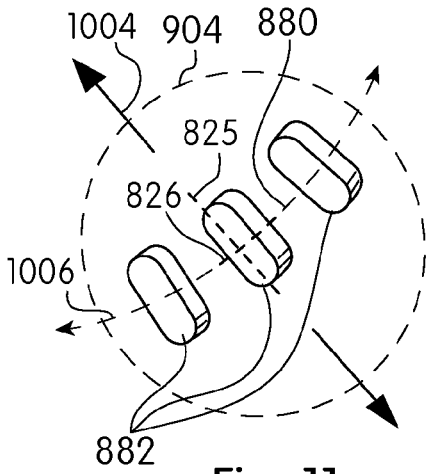
FIG. 11 is an enlarged isometric view of an alternate embodiment of another set of tread elements.

FIG. 9 is a bottom isometric view of article of footwear 200 in a rest or original position. Preferably, article of footwear 200 includes outsole 100 with circular tread pattern 802. Selected forefoot tread elements 902, associated with second circular tread 830, and selected heel tread elements 904, associated with eighth circular tread 880, are shown in FIG. 9. For clarity, only selected tread elements 902, 904 are shown in FIGS. 9-11. It should be kept in mind that outsole 100 would include all of the tread elements associated with circular tread pattern 802 as shown in FIG. 8 and that the following description of the operation of selected tread elements 902, 904 are applicable to other all other tread elements in circular pattern 802.

As shown in FIG. 10, which is an enlarged view of selected forefoot tread elements 902, and FIG. 11, which is an enlarged view of selected heel tread elements 904, selected tread elements 902, 904 extend generally away from outsole 100 and are vertically disposed when at rest. Selected tread elements 902, 904 also assume this rest position when the wearer is performing any activity other than pivoting, such as running or walking. In other words, selected tread elements 902, 904 act like conventional treads under most conditions.

Selected tread elements 902, 904 remain generally vertically disposed, and their motion is restrained by their shape. The oblong or racetrack shape of selected tread elements 902, 904 helps to prevent their motion or deflection in radial direction 1004 (as shown in FIGS. 10 and 11). In other words, selected tread elements 902, 904 are less likely to lean or tilt along their longer dimension or side, which is radial direction 1004. As selected tread elements 902, 904 are not set into grooves, the overall size of selected tread elements 902, 904 is preferably larger than selected tread elements 202, 204 in the embodiment shown in FIG. 1, discussed above. For example, selected tread elements 902, 904 are preferably larger in height (distance from outsole 100), width along major axis 825, and width along minor axis 826.

The shape and position of selected tread elements 902, 904, however, contribute to the ability of outsole 100 to permit pivoting. While selected tread elements 902, 904 are restrained in radial direction 1004 by their shape, they are not restrained in circumferential direction 1006. Also, the shape of selected tread elements 902, 904 allows them to deflect or bend in the circumferential direction 1006. This is because this circumferential bending occurs along the shorter dimension or side.

Figure 12:
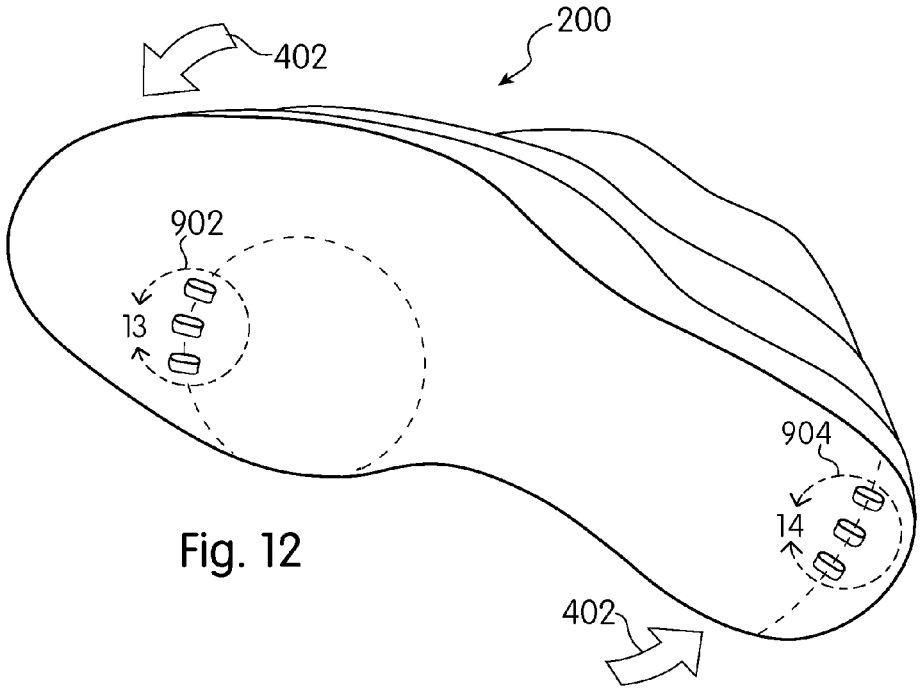
FIG. 12 is a bottom isometric view of an alternate embodiment of an article of footwear in a pivoted position.
Figure 13:
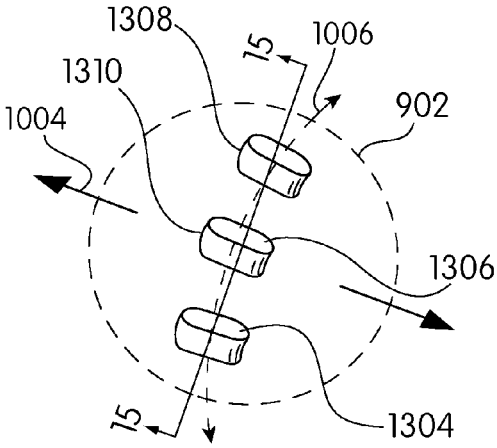
FIG. 13 is an enlarged isometric view of an alternate embodiment of a tread element.
Figure 14:
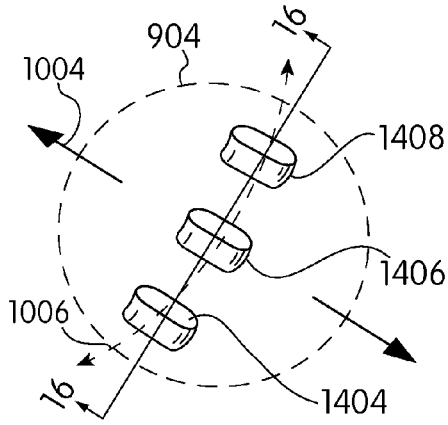
FIG. 14 is an enlarged isometric view of an alternate embodiment of another set of tread elements.

FIGS. 12-14 are isometric views of article of footwear 200 after pivoting in the counter clockwise direction 402. The deflection of selected tread elements 902, 904 can be observed in FIGS. 12-14. As shown in FIGS. 12-14, selected tread elements 902, 904 deflect or lean after outsole 100 has been pivoted about pivot portion 110.

Figure 15:
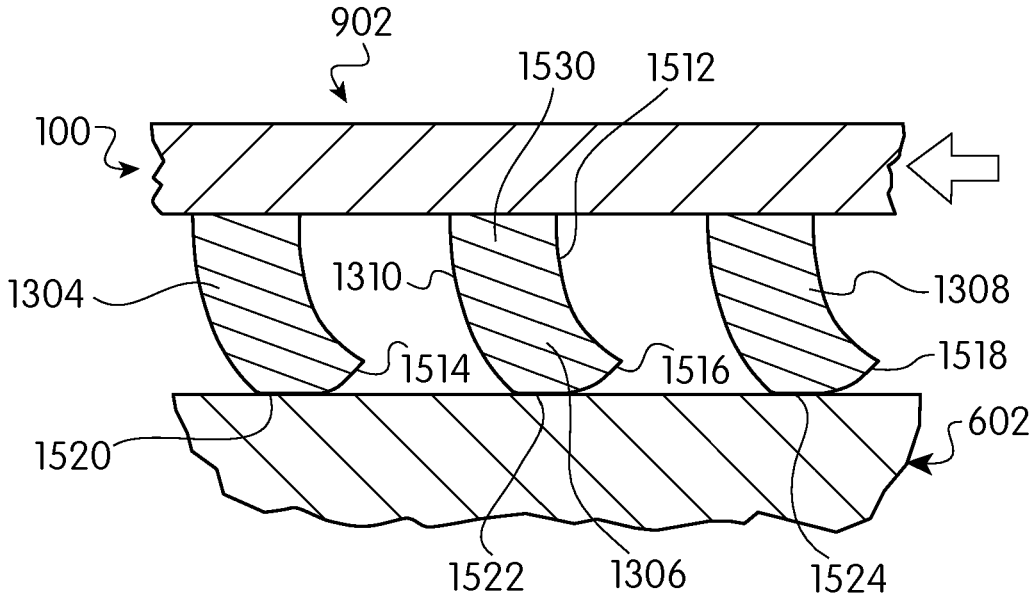
FIG. 15 is a cross-sectional view of the tread elements of FIG. 13 taken along line 15-15 thereof.
Figure 16:
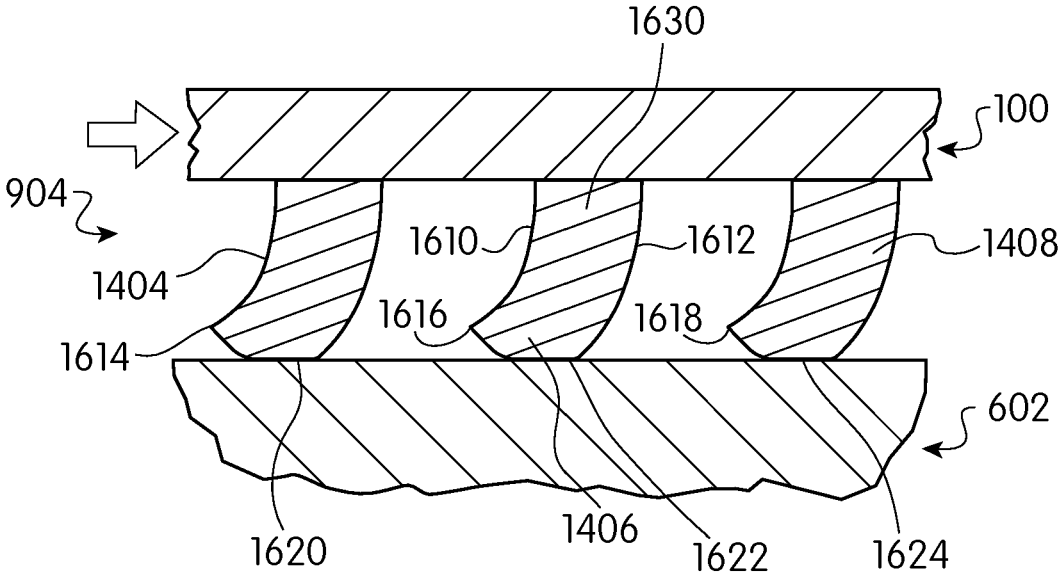
FIG. 16 is a cross-sectional view of the tread elements of FIG. 14 taken along line 16-16 thereof.

This deflected condition of selected tread elements 902, 904 can also be observed in FIGS. 15 and 16. As shown in FIG. 15, central tread element 1306 includes first sidewall 1310 and second sidewall 1512. Preferably, first and second sidewalls 1310 and 1512 are circumferentially spaced and are the longer sidewalls of central tread element 1306. Unlike the embodiment shown in FIG. 1, as described above, when central tread element 1306 is in the deflected condition, as shown in FIG. 15, first sidewall 1310 does not come into contact with first tread element 1304 and second sidewall 1512 does not come into contact with second tread element 1308. Similarly, when central tread element 1406 is in the deflected condition, as shown in FIG. 16, first sidewall 1610 does not come into contact with first tread element 1404 and second sidewall 1612 does not come into contact with second tread element 1408.

When outsole 100 is pivoted, the tread elements can bend or deflect as if they were cantilever mounted to outsole 100. In the forefoot portion, as shown in FIG. 15, an upper portion 1530 of central tread element 1306 is mounted to outsole 100. Central tread element 1306 extends from upper portion 1530. When outsole 100 is pivoted in a counter-clockwise direction, outsole 100 moves towards to left as shown in FIG. 15. The bottom portion 1516, which was originally in contact with the ground 602, becomes tilted when outsole 100 is pivoted. After being pivoted, a contact portion 1522 remains in contact with the ground 602, while a portion of bottom portion 1516 may lose contact with the ground 602. First and second tread elements 1504 and 1508 can bend in a similar manner, providing contact portions 1520 and 1524, respectively.

In heel portion 824, as shown in FIG. 16, an upper portion 1630 of central tread element 1406 is mounted to outsole 100. Central tread element 1406 extends from upper portion 1630. When outsole 100 is pivoted in a counter-clockwise direction, outsole 100 moves towards the right as shown in FIG. 16. In other words, tread elements in heel portion 822 bend in the opposite direction to those in forefoot portion 824. The bottom portion 1616, which was originally in contact with the ground 1602, becomes tilted when outsole 100 is pivoted. After being pivoted, a contact portion 1622 remains in contact with the ground 602, while a portion of bottom portion 1616 may lose contact with the ground 602. First and second tread elements 1604 and 1608 may bend in a similar manner. When First tread element 1604 bends, a bottom portion 1614 lifts while a contact portion 1620 remains in contact with ground 602. Similarly, when second tread element bends, a bottom portion 1618 lifts while a contact portion 1624 remains in contact with ground 602.

As in the embodiment shown in FIG. 1, the elongated shape of the tread elements help to increase the contact area between the tread elements and ground 602 when outsole 100 is pivoted, thus providing increased traction and stability while pivoted. In this way, outsole 100 with its circular tread pattern 802 can provide improved traction both while at rest and while pivoted. In other embodiments, the tread elements may be made thicker so that one side of the tread element crushes, as opposed to bending, while pivoting.

Figure 17:
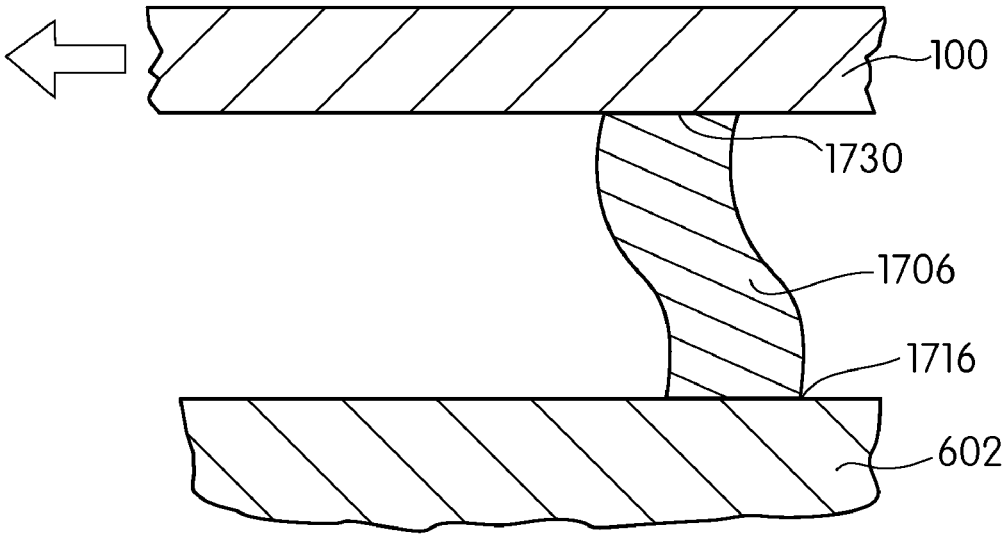
FIG. 17 is a cross-sectional view of one of the tread elements of FIG. 13, shown at the beginning of a pivoting motion.
Figure 18:
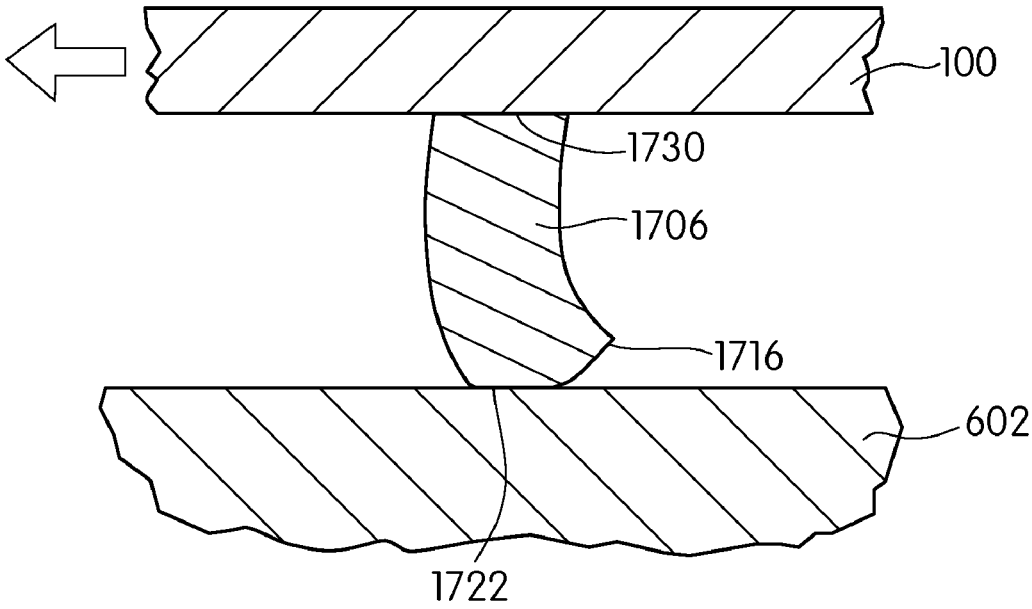
FIG. 18 is a cross-sectional view of the tread element shown in FIG. 17, shown at a later point in the pivoting motion.

While bending of the tread elements occurs as shown in FIGS. 15 and 16, when initially subjected to a pivoting motion, the tread elements of circular tread pattern 802 do not necessarily bend immediately. FIGS. 17 and 18 show how an exemplary tread element, tread element 1706 behaves in such a case. For example, friction between tread element 1706 and ground 602 or embedding of tread element 1706 within ground 602 may hold bottom portion 1716 stationary. As the article of footwear begins to turn, outsole 100 is moved to the right. An upper portion 1730 of tread element 1706 is attached to outsole 100 and readily moves in the direction of outsole 100. However, bottom portion 1716 remains flush with ground 602 and resists moving in the direction in which outsole 100 is moving. In reaction to these opposing forces, tread element 1706 essentially shears and adopts a wavy cross-sectional profile, as shown in FIG. 17. Eventually, however, the force of the pivot tends to overcome the force or forces keeping bottom portion 1716 stationary. FIG. 18 shows tread element 1706 at this later moment in time. Tread element 1706 has bent as described above, so that bottom portion 1716 is lifted and contact portion 1722 remains in contact with ground 602.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an outsole including a circular tread pattern disposed on a forefoot portion;

the circular tread pattern including a first circular tread having a first radius, the first radius being the smallest radius of any circular tread;

the first circular tread extending less than 360 degrees in a circumferential direction around a center of the circular tread pattern;

the first circular tread comprising a plurality of tread elements disposed in a first circular groove;

the tread elements having a generally elongated shape with a radial width and a circumferential thickness, wherein the radial width is greater than the circumferential thickness;

the circular tread pattern also including a second circular tread having a second radius greater than the first radius; and wherein the second circular tread also extends less than 360 degrees in a circumferential direction around a center of the circular tread pattern.

2. The article of footwear according to claim 1, wherein the circular tread pattern includes a third circular tread.

3. The article of footwear according to claim 2, wherein the third circular tread has a third radius, the third radius being larger than the second radius, and wherein the third circular tread is discontinuous.

4. The article of footwear according to claim 3, wherein a first portion of the third circular tread is disposed forward of a slot disposed in a pivot portion.

5. The article of footwear according to claim 4, wherein a second portion of the third circular tread is disposed rearward of the slot.

6. An article of footwear comprising:

an outsole including a circular tread pattern disposed on a forefoot portion;

the circular tread pattern including a first circular tread having a first radius, the first radius being the smallest radius of any circular tread;

the first circular tread extending less than 360 degrees in a circumferential direction around a center of the circular tread pattern;

the first circular tread comprising a plurality of tread elements disposed in a first circular groove; and the outsole including a heel portion with a tread pattern different than the circular tread pattern disposed on the forefoot portion.

7. The article of footwear according to claim 6, wherein the first circular tread includes a plurality of tread elements disposed in a first circular groove;

the tread elements having a generally elongated shape with a major axis oriented radially and a minor axis oriented circumferentially.

8. The article of footwear according to claim 6, wherein a slot extends through a pivot portion located within the first circular tread, wherein the slot improves flexibility in bending of the article of footwear.

9. The article of footwear according to claim 6, wherein the circular tread pattern also includes a second circular tread having a second radius greater than the first radius; and wherein the second circular tread also extends less than 360 degrees in a circumferential direction around a center of the circular tread pattern.

10. The article of footwear according to claim 9, wherein the circular tread pattern includes a third circular tread adjacent to the second circular tread having a third radius greater than the second radius, wherein the third circular tread is discontinuous and includes a first portion separated from a second portion.

11. The article of footwear according to claim 10, wherein the circular tread pattern includes a fourth circular tread adjacent to the third circular tread having a fourth radius greater than the third radius, wherein the fourth circular tread is discontinuous and includes a first portion separated from a second portion.

12. The article of footwear according to claim 11, wherein the circular tread pattern includes a fifth circular tread adjacent to the fourth circular tread having a fifth radius greater than the fourth radius, wherein the fifth circular tread extends less than 180 degrees in a circumferential direction.

13. The article of footwear according to claim 6, wherein a slot extends through a pivot portion located within the first circular tread, wherein the slot improves flexibility in bending of the article of footwear.

14. An article of footwear comprising:

an outsole including a circular tread pattern disposed on a forefoot portion of the outsole;

the circular tread pattern including a first circular tread having a first radius, the first radius being the smallest radius of any circular tread;

the first circular tread extending less than 360 degrees in a circumferential direction around a center of the circular tread pattern;

the first circular tread comprising a plurality of tread elements disposed in a first circular groove; and a slot extending through a pivot portion located within the first circular tread, wherein the slot improves flexibility in bending of the article of footwear.

15. The article of footwear according to claim 14, wherein the outsole includes a second slot laterally spaced from the first slot and aligned with the first slot.

16. The article of footwear according to claim 15, wherein the outsole includes a third slot disposed rearward of the second slot.

17. The article of footwear according to claim 15, wherein the second slot is disposed between a first portion of a third circular tread and a second portion of a third circular tread, wherein the third circular tread is disposed radially outward of the first circular tread.

18. The article of footwear according to claim 14, wherein the outsole includes a fifth circular tread disposed radially outward of the first circular tread, a second circular tread, a third circular tread and a fourth.

19. The article of footwear according to claim 18, wherein the fourth circular tread extends less than 180 degrees in a circumferential direction.

20. The article of footwear according to claim 14, wherein the outsole consists essentially of five circular treads.

* * * * *